US005222011A

United States Patent [19]

Braun

[11] Patent Number: 5,222,011

[45] Date of Patent: Jun. 22, 1993

[54] LOAD DRIVER CIRCUIT

[75] Inventor: Jeffrey J. Braun, Mesa, Ariz.

[73] Assignee: Motorola, Inc., Schaumburg, Ill.

[21] Appl. No.: 787,443

[22] Filed: Nov. 4, 1991

[51] Int. Cl.[5] ..... H01H 47/32

[52] U.S. Cl. ..... 361/154; 361/152; 361/195

[58] Field of Search ..... 361/139, 152, 154, 160, 361/170, 187, 195

[56] References Cited

U.S. PATENT DOCUMENTS

| | | | |
|---|---|---|---|
| 4,300,508 | 11/1981 | Streit et al. | 361/154 |
| 4,680,667 | 7/1987 | Petrie | 361/154 |
| 4,729,056 | 3/1988 | Edwards et al. | 361/153 |
| 4,736,267 | 4/1988 | Karlmann et al. | 361/101 |
| 4,763,222 | 8/1988 | Heaston et al. | 361/195 |
| 4,764,840 | 8/1988 | Petrie et al. | 361/154 |
| 4,930,040 | 5/1990 | Binarsch et al. | 361/154 |

*Primary Examiner*—Jeffrey A. Gaffin
*Attorney, Agent, or Firm*—Phillip H. Melamed

[57] ABSTRACT

Load driver circuit (10) has first and second comparators (Cphd 1, $C_2$) which receive a load current signal ($V_s$) indicative of current flowing through a load (11). The comparators provide, as output signals, set on and set off signals (at 21, 23) in response to comparing the load current signal ($V_s$) with first and second thresholds ($T_1$, $T_2$). Driver circuitry (27, 43, 12) receives the set on and set off signals and provides a current control signal (at 18) for controlling load current. Preferably, disabling circuitry (30–34) disables the comparators ($C_1$, $C_2$) after and in response to the comparators providing their respective output signals (at 21, 23). Also, preferably enabling circuitry (40–42) enables the comparators ($C_1$, $C_2$) in response to comparing a sensed voltage (at 17), indicative of voltage at an output terminal of a switching device (12) that controls load current, with respect to a predetermined voltage (2.5 volts). The selective enabling/disabling of the Comparators ($C_1$, $C_2$) results in minimizing the possible effect of noise with respect to controlling load current since undesired false or repetitive outputs of the comparators are minimized.

20 Claims, 2 Drawing Sheets

LOAD DRIVER CIRCUIT

FIELD OF THE INVENTION

The present invention relates to the field of load driver circuits in which circuitry is utilized to control the current through a load. More particularly, a load driver circuit is provided which can be utilized to maintain a desired average load current in a load by alternately turning on and off a driver stage which controls the current in the load.

BACKGROUND OF THE INVENTION

Many times it is desired to control the average current through an electrical load so as to ensure the proper operation of the electrical load. For electrical loads such as the inductance coil of a solenoid relay, many prior circuits have controlled average current through the solenoid inductance by alternately turning on and off a switching device connected in series with the solenoid inductance. This preferred technique minimizes power dissipation by avoiding operating the control device in a linear mode since the control device is operated in a switching mode. Typically, the current through the solenoid inductance is sensed and the switching device is turned on when the solenoid current is below a certain level and turned off when the solenoid current exceeds a certain level. In this manner, the solenoid current will oscillate repetitively between maximum and minimum levels and thereby a desired average current level is achieved. Examples of such prior art solenoid current control systems are shown in U.S. Pat. Nos. 4,764,840, 4,300,508, 4,729,056, 4,736,267, and 4,680,667. Some of these prior systems utilize separate high and low current threshold comparators to accurately control the maximum and minimum load current levels.

Prior high and low comparator systems, such as those noted above, are subject to generating undesired or false turn-on and turn-off signals which are coupled to the switching device. This is because of noise which corrupts a load current sense signal provided to the high and low current threshold comparators. Thus, undesired or false switching of the switching device or the circuitry which generates the current control signal provided to the switching device can occur. This can disrupt the maintaining of a desired average current in the solenoid inductance.

SUMMARY OF THE INVENTION

An embodiment for a load driver circuit is described herein which comprises: first comparator for receiving a load current signal indicative of current flowing through a load and for providing as an output signal a set on signal in response to the load current signal being less than a first threshold; second comparator for receiving the load current signal and providing as an output signal a set off signal in response to the load current exceeding a second threshold more than the first threshold; and driver means coupled to the first and second comparators for receiving the set on and set off signals and providing a load current control signal for controlling current flow through the load in response thereto.

According to one aspect of the present invention there is provided a disabling means for disabling at least one of the first and second comparators in response to and after the one comparator provides its output signal.

A similar disabling apparatus may also be provided for the other one of the first and second comparators. Preferably the first and second comparators are maintained in their disabled state by the disabling apparatus until the next time occurrence of a set off or set on signal by the comparator which is not disabled. In this manner the generation of false or repetitive set on or set off signals due to noise signals is minimized.

According to another aspect of the present invention, enabling means is provided for the first and second comparators which enables at least one comparator in response to comparing a sensed voltage, indicative of the voltage at one output terminal of an output switching device that controls current in the load, with respect to a predetermined voltage. Prefereably each of the comparators is alternately enabled by the enabling means. In this manner the first and second comparators are selectively enabled when the sensed voltage indicates that the first or second comparators may have to respond to the load current signal by providing their respective set on or set off signals.

According to either of the above aspects of the present invention, or their combination, an improved load driver circuit is provided in which the likihood of creating false outputs from the first or second comparators is minimized because these comparators are either disabled at times when they are not expected to produce an output and/or because they are only selectively enabled at times when they are expected to produce an output in response to the monitored load current signal. This substantially minimizes the potential for false or erroneous operation of the load driver circuit.

BRIEF DESCRIPTION OF THE DRAWINGS

The present invention can be better understood by reference to the drawings in which.

DESCRIPTION OF THE PREFERRED EMBODIMENTS

Figure 1:
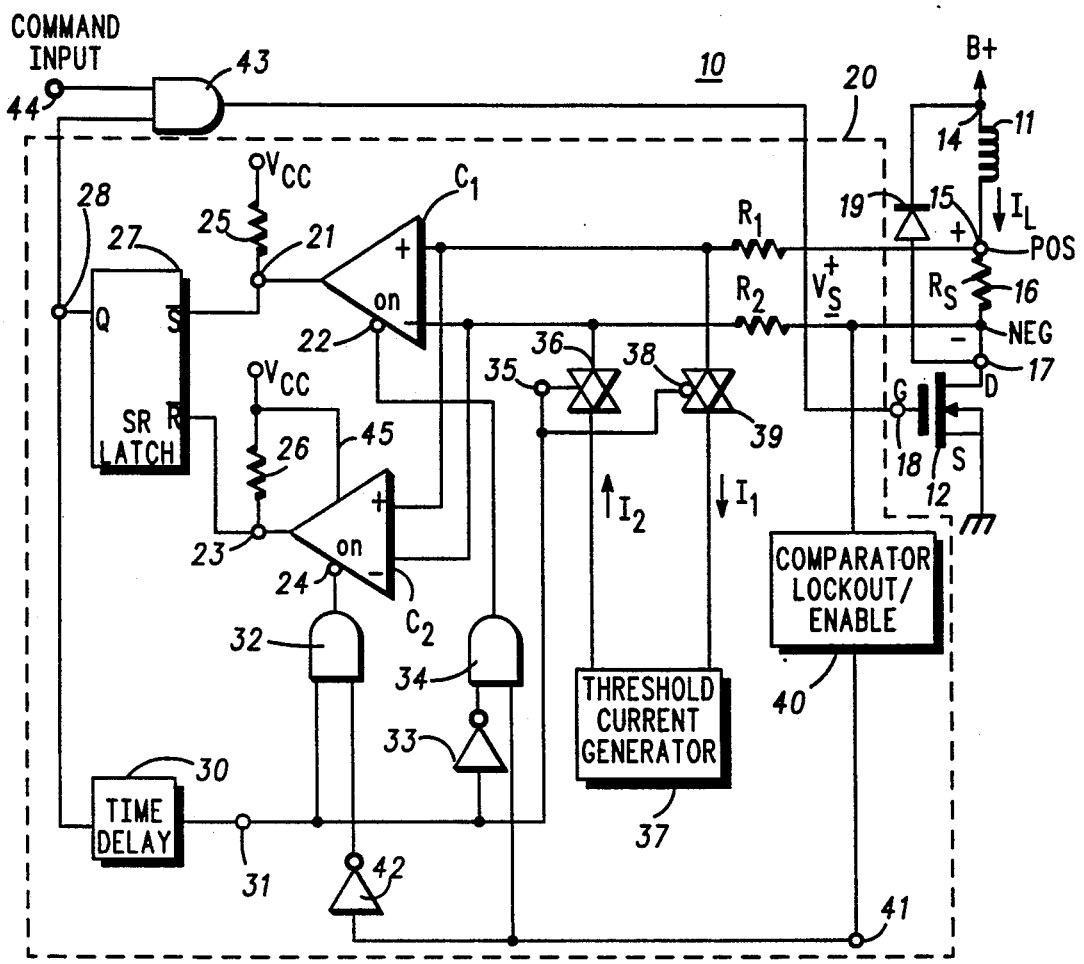
FIG. 1 is an electrical schematic block diagram of a load driver circuit constructed in accordance with the present invention.

Referring to FIG. 1, a load driver circuit 10 is illustrated in which the load current $I_L$ through a desired load, comprising an inductive solenoid coil 11, is controlled by the repetitive switching on and off of an output switching device 12, comprising an FET transistor, connected in series with the solenoid coil 11. One end of the solenoid coil 11 is connected to a power supply terminal 14 at which a voltage potential B+ is provided. The other end of the solenoid coil 11 is connected to a positive sense terminal 15. A sensing resistor $R_s$, also referred to herein as resistor 16, is provided between the positive sense terminal 15 and a negative sense terminal 17 which is directly connected to a drain electrode D of the FET transistor 12. The transistor 12 has a source electrode S directly connected to ground and a control input electrode G, corresponding to the gate electrode of the transistor, connected to a control input terminal 18. A flyback or recirculation diode 19 is connected between the B+ terminal 14 and the negative sense terminal 17 in conventional fashion.

Essentially, in response to high or low logic states provided at the control input terminal 18, the transistor 12 is switched on or off and this controls the load current $I_L$ in the solenoid coil 11. The magnitude of this load current is sensed by a load current signal corresponding to a differential sense voltage $V_s$ that is developed across the sensing resistor 16. The magnitude of the signal $V_s$ varies directly in accordance with the magnitude of the load current through coil 11. The differential sense voltage $V_s$ will be provided to two separate comparators that will determine a switching current control input signal to be provided at the terminal 18.

Figure 2:
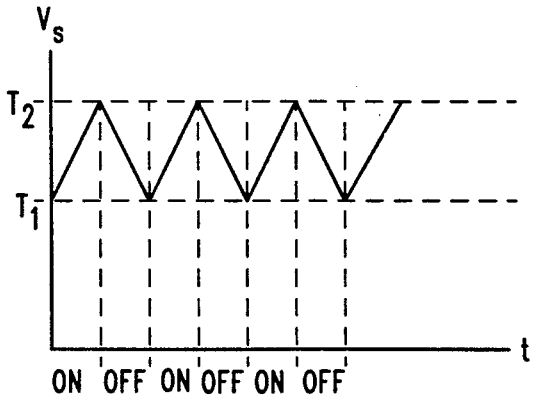
FIG. 2 is a graph of a voltage waveform which indicates the general operation of the load driver circuit shown in FIG. 1.

Referring now to FIG. 2, the overall operation of the load driver circuit 10 will be briefly explained. FIG. 2 is a graph of the sense voltage $V_s$ versus time after a steady state condition has been achieved during which a desired average load current is provided. For values of the sense voltage $V_s$ below a threshold $T_2$, corresponding to a maximum load current threshold level, the transistor 12 is maintained in a fully conductive state. This results in the ramping up or increasing of load current through the load inductance coil 11. The current through the coil 11 cannot increase instantaneously and this is the reason for the ramping up of the current sense signal $V_s$ as shown in FIG. 2. When the load current exceeds a maximum current threshold, corresponding to the sense voltage threshold $T_2$, the switching transistor 12 will be turned off resulting in a corresponding decrease or ramping down of the load current. This will continue until the load current falls below a minimum load current threshold corresponding to a lower voltage threshold $T_1$ shown in FIG. 2. When this occurs, the transistor 12 will again be switched on resulting in a repetition of the previously described cycle. The end result is that an average current through the inductive load 11 is maintained at a level between load current thresholds corresponding to the voltage thresholds $T_2$ and $T_1$ shown in FIG. 2. Many prior load driver circuits which control current in an inductive load operate generally as described above. However, prior load driver circuits were subject to erroneous operation because noise on a load current sense signal, such as the signal $V_s$, might result in unwanted switching or nonswitching of the transistor 12 such that a desired average load current would not be achieved. The load driver circuit described herein minimizes the chance of this occurring through the utilization of the circuitry which will now be described.

Referring again to FIG. 1, preferably the voltage sense signal $V_s$, which is indicative of the solenoid load Current $I_L$, is provided as a differential input voltage signal to an integrated circuit (IC) 20 shown within dashed outline in FIG. 1. More specifically, the terminal 15 is coupled through a resistor $R_1$ to a positive input of a high side comparator $C_1$ and the terminal 17 is coupled through a resistor R2 to a negative input of the comparator $C_1$. An output of the comparator $C_1$ is provided at a terminal 21 and the comparator has a control input terminal 22 wherein for a high logic state at the terminal 22 the comparator is enabled or turned on and for a low logic state at this terminal the comparator is disabled or turned off. The resistors $R_1$ and $R_2$ also COuple the sense voltage $V_s$ to positive and negative inputs of a low side comparator $C_2$ which provides an output at a terminal 23 and has an input control terminal 24 which functions identically to input control terminal 22 of the comparator $C_1$.

Each of the comparator output terminals 21 and 23 is connected to a five volt bias supply voltage Voo through pull up resistors 25 and 26, respectively. The comparator output terminals 21 and 23 are connected, respectively, to not set and not reset inputs terminals $\overline{S}$ and $\overline{R}$ of a set-reset latch 27 which provides an output at a terminal 28 corresponding to the Q output terminal of the latch. The latch output terminal 28 is connected as an input to a time delay circuit 30 which provides a delayed output at a terminal 31. The terminal 31 is connected as an input to an AND gate 32 having its output connected to the terminal 24. The terminal 31 is also connected through an inverting stage 33 as an input to an AND gate 34 having its output connected to the terminal 22. The terminal 31 is also connected to a noninverting control input terminal 35 of a series pass gate 36 connected between the negative input of the comparator $C_1$ and a threshold current generator 37. Similarly, the terminal 31 is connected to an inverting control input terminal 38 of a series pass gate 39 connected between the threshold current generator 37 and the positive input of the comparator $C_1$. The negative sense terminal 17 is connected as an input to a comparator lockout/enable circuit 40 on the IC 20, and an output terminal 41 of the comparator lockout and enable circuit 40 is directly connected as an input to the AND gate 34 and is connected through an inverter stage 42 as an input to the AND gate 32. All of the above described components are preferably within the integrated circuit 20 as shown in FIG. 1.

The switching transistor 12 and the current sensing resistor 16 are not shown within the IC 20 since these are high power components and probably cannot be economically implemented in a single IC which contains the other electronics shown within the dashed outline 20 in FIG. 1. Besides the components discussed above, an AND gate 43 is provided such that the latch output terminal 28 is connected as an input thereto along with a terminal 44 at which a command input signal is provided. An output of the AND gate 43 is directly connected to the control terminal 18 corresponding to the gate electrode of the transistor 12. While the AND gate 43 is not shown within the integrated circuit 20, this component, or an equivalent of this component, could be readily provided within the integrated circuit 20.

It should be noted that preferably the low side comparator $C_2$ receives operating potential by virtue of a connection 45 between the comparator and the five volt bias supply potential $V_{cc}$. No such connection is shown for the comparator $C_1$ since operating potential for this comparator will preferably be provided by the connections of the positive and negative inputs of the comparator $C_1$ to the terminals 15 and 17. The comparator $C_1$ will be only rendered operative or enabled by the comparator lockout/enable circuit 40 when a sufficient potential exists at the terminals 15 and 17. Thus the comparator $C_1$ will only be enabled when the terminals 15 and 17 can provide sufficient operating potential to insure proper operating potential for the comparator $C_1$. The detailed operation of the load driver circuit 10 will now be discussed.

The voltage sense signal $V_s$, which is indicative of the instantaneous magnitude of the load current $I_L$, is provided as a differential input to the integrated circuit 20. The circuit 20 causes the switching output transistor 12 to be repetitively turned on and off by repetitively switching it between conductive and nonconductive states. During the conductive state of the transistor 12 the terminal 17 will be at substantially ground potential and substantially all of the load current $I_L$ will pass throu9h the sensing resistor 16 since the comparators $C_1$ and $C_2$ have high input impedances and the resistors $R_1$ and $R_2$ are substantially higher than the magnitude of the resistor 16 and the impedance from terminal 17 to ground when the transistor 12 is on. The result is that when the transistor 12 is turned on current through the solenoid coil 11 will start to increase and the magnitude of the sense voltage $V_s$ will similarly increase When the transistor 12 is turned off, the load current $I_L$ will start to decrease but will continue in its same direction due to the action of the flyback or recirculation diode 19. This will result in a gradual decrease of the sense voltage $V_s$. These increases and decreases of the current sensing voltage $V_s$ provide the current sense input to the integrated circuit 20 which will control the repetitive turning on and turning off of the transistor 12 so as to maintain a desired average current level in the solenoid coil 11 when such an average current is desired.

The signal at the command input terminal 44 will be high whenever a desired average current is to be provided for the solenoid coil 11. Thus, when it is desired to actuate the solenoid coil 11, a high signal is then provided at the terminal 44 by a command circuit not shown in FIG. 1. At the time the signal at terminal 44 initially goes high, there will be a high logic signal at the output terminal 28 of the latch 27. The reason for the initial high logic state at terminal 28 can be explained as follows.

Prior to generating a high signal at the terminal 44, the transistor 12 was off because the AND gate 43 was producing a low output state and that ensured the off condition of the transistor 12. When the transistor 12 is off and has been off for a substantial time, the load current $I_L$ will have decayed to approximately zero and there will be essentially no voltage across the sense resistor 16. Note that FIG. 2 represents variations of the sense voltage $V_S$ during a steady state repetitive switching condition for the transistor 12, which condition is implemented in response to the presence of a high logic signal at the terminal 44. Thus an initial approximately zero voltage condition of the voltage $V_S$ is not shown in FIG. 2. However, for such an initial zero voltage for $V_s$, the comparator $C_1$, since the differential voltage $V_S$ will be far below the thresholds $T_1$ and $T_2$, will provide a low logic state at its output terminal 21. This initial low logic state, also referred to herein as a set on signal, will result in setting the output of the latch 27 high at the terminal 28. In response to the high signal at the terminal 28, the time delay circuit 30 will implement a corresponding high signal at the terminal 31 at least five, and preferably thirty, nanoseconds later. When this delayed high logic state at the terminal 31 occurs, this will result in disabling the comparator $C_1$ because of the action of the inverting stage 33 and the AND gate 34 providing a low logic state at the terminal 22 to effectively turn-off (disable) the comparator $C_1$. However, the output of the latch 27 will remain set high. This condition, in combination with the high command signal at 44 will turn on transistor 12.

The presence of a high logic state at the terminal 31 will also result in closing the series pass gate 36 and opening the series pass gate 39, whereas with a low logic state at the terminal 31 the opposite conditions existed. The threshold current generator 37 essentially provides two predetermined current levels $I_1$ and $I_2$ having polarities as indicated in FIG. 1. The series gates 36 and 39 selectively provide one or the other of these currents to establish the switching thresholds $T_1$ and $T_2$ in accordance with the following equations:

Ti $T_1=I_1(R_1)$ $^3$ $T_2=I_2(R_2)$

From the above equations it is clear that the logic state at the terminal 31 determines which one of the thresholds will be implemented by virtue of enabling or disabling the gates 36 and 39 such that only one of the currents $I_1$ or $I_2$ will set a threshold for the comparators $C_1$ and $C_2$. However, the signal at the terminal 31 will also determine, by virtue of the AND gates 32 and 34, which one of these comparators $C_1$ and $C_2$ will be disabled. The Comparators $C_1$ and $C_2$, once disabled by one of the AND gates 32 or 34, will remain disabled until at least the next time occurrence of a low output by the nondisabled comparator. This is further explained in the following paragraphs.

When it is desired to actuate the solenoid 11, a high logic signal is provided at the terminal 44. As was explained above, a high logic signal is already provided at the terminal 28 when there has previously been no load current flowing in the solenoid coil 11. Therefore, the AND gate 43 will turn on the switching transistor 12 and cause curr4ent to increase in the load coil 11. During this time of current increase, high logic states are maintained at the terminals 28 and 31 because of the holding action of the latch 27. The high logic state at the terminal 31 ensures that the series gate 36 is enabled and that the series gate 39 is disabled. The logic state at the terminal 31 also ensures that the comparator $C_1$ is disabled due to the action of the inverter 33 and the AND gate 34. Thus only the comparator $C_2$ can be enabled during the increase of current caused by the turning on of the transistor 12.

The enabling of the comparator $C_2$ occurs in accordance with the output of the comparator lockout/enable circuit 40 which output is provided at the terminal 41. The comparator lockout/enable circuit 40 is actually just a comparator circuit in which the voltage at the terminal 17 is provided at a positive input of a comparator that receives at its negative input a predetermined, fixed 2.5 volt voltage. Thus, if the voltage at terminal 17 is less than 2.5 volts, the logic state or voltage level at the terminal 41 is low and this results in enabling the comparator $C_2$ if a high logic state is provided at terminal 31. If the voltage at the terminal 17 is higher than 2.5 volts, then a high logic state is provided at the terminal 41 and the comparator $C_2$ is disabled by the comparator lockout/enable circuit 40, via the inverter stage 42 and AND gate 32, if a high logic state is provided at terminal 31.

Prior to the transistor 12 being turned on after it has been off for an appreciable time, a high voltage (B+) is present at the terminal 17 resulting in the comparator lockout/enable circuit 40 disabling the comparator $C_2$. However, when the transistor 12 is turned on, the voltage at the terminal 17 will be approximately ground potential and a low logic state is provided at the terminal 41 thus enabling the low side or $C_2$. With comparator $C_2$ enabled, and the gate 36 enabled, the comparator $C_2$ proceeds with its function of comparing the sense voltage $V_s$ with the predetermined maximum current threshold corresponding to the threshold $T_2$. When this threshold is exceeded, the comparator $C_2$ will provide a low output, also referred to herein as a set off signal, at terminal 23 resulting in the resetting of the latch 27 such that its output is now zero or a low logic state. This results in immediately turning off the transistor 12 due to the operation of the AND gate 43, and the load current $I_L$ starts to decrease. This also results, after the nanosecond delay implemented by the delay circuit 30, in subsequently turning off (disabling) the comparator $C_2$ and permitting the comparator $C_1$ to now be enabled by action of the comparator lockout/enable circuit 40 due to the action of gates 32 and 34 and inverter 33. The circuit 40 will enable the comparator $C_1$ because the voltage at terminal 17 will rise, after transistor 12 goes off, toward the voltage B+. In addition to disabling the comparator $C_2$, providing a low signal at the terminal 31 also disables the gate 36 and enables the gate 39 to establish the minimum current threshold corresponding to the threshold $T_1$ which threshold will be utilized by the comparator $C_1$ when it is enabled.

As the voltage at the terminal 17 rises when the transistor 12 is turned off, eventually this voltage will exceed 2.5 volts and the comparator lockout/enable circuit 40 will produce a high logic state at the terminal 41. This will result in enabling the comparator $C_1$ due to the action of the AND gate 34. With the comparator $C_1$ now enabled, when the sense voltage $V_s$ goes below the threshold $T_1$ the comparator $C_1$ will now produce a low signal (set on signal) at its output terminal 21 resulting in setting the latch 27 to a high logic state and implementing the turning on of the transistor 12. This also results in the subsequent disabling of the comparator $C_1$ and the re-establishment of the threshold $T_2$.

Essentially, the configuration shown in FIG. 1 implements the repetitive turning on and off of the transistor 12 when a command input signal high logic state is provided at the terminal 44. Two separate comparators $C_1$ and $C_2$ are utilized to essentially perform proper switching at maximum and minimum load current thresholds corresponding to the voltage thresholds $T_2$ and $T_1$. However, the driver circuit 10 differs from prior load driver circuits in that once any of the comparators $C_{1\ or\ C2}$ produces an Output signal indicative of the load current being above the maximum load current or below the minimum load current, then that comparator will be subsequently disabled, after a delay time, such that that comparator cannot produce subsequent additional output signals which might interfere with the operation of the load circuit 10. This disabling of one of the comparators will be maintained until the next time occurrence of an output (set on or set off signal) by the other one of the comparators $C_1$ or $C_2$ which is not disabled. Thus the comparators $C_1$ and $C_2$ alternately disable themselves. This minimizes the effect of noise on the operation of the circuit 10 since noise on the signal $V_s$ cannot result in multiple set on signals by the comparator $C_1$ at terminal 21 or multiple set off signals by the comparator $C_2$ at terminal 23 because after the first set on or set off signal provided at the terminals 21 or 23 these comparators are disabled until the other comparator provides an output. In addition, the comparator lockout/enable circuit 40 ensures that the comparators $C_1$ and $C_2$ will only be enabled for providing an output at appropriate times. For example, it makes no sense to enable the low side comparator $C_2$, whose output might result in turning the transistor 12 off, unless you are sure that the transistor 12 is already on. Thus the comparator lockout/enable circuit 40 ensures that the low side comparator $C_2$ will only be enabled if the voltage at the terminal 17 is below 2.5 volts. This will clearly occur when the transistor 12 is on. When the transistor 12 is off and maintained in an off condition, the voltage at the terminal 17 will rise to B+ and therefore be above 2.5 volts. Under such a condition of course the comparator lockout/enable circuit 40 should not enable the comparator $C_2$ and allow this comparator to potentially generate additional set off signals at the terminal 23 since these set off signals would clearly have no beneficial effect because the transistor 12 was already off. Thus the present circuit 10 eliminates this possibility.

The action of the comparator lockout/enable circuit 40 with respect to the comparator $C_1$ is similar except that in that case it is even more significant that the comparator $C_1$ is only enabled if the voltages at the terminal 17 is above 2.5 volts. This is because the voltage at the terminals 15 and 17 actually provide some internal biasing voltage for the comparator $C_1$ as it is preferably implemented in IC form. Because of this, you certainly wouldn't want to enable the comparator $C_1$ if it was not receiving adequate bias voltage since you could not then rely on the output of the comparator. The comparator lockout/enable circuit 40 eliminates this problem as well as ensuring that the comparator $C_1$ will only be enabled if the transistor 12 is off.

Essentially, the comparator lockout/enable circuit 40 will enable the comparators $C_1$ and $C_2$ in response to comparing a sense voltage, such as the voltage at the terminal 17 which is indicative of the voltage at the drain electrode D of the switching device 12, with respect to a predetermined voltage level, which is preferably fixed at 2.5 volts in the present embodiment.

This assures that the comparators $C_1$ and $C_2$ will only be enabled when it is time for those comparators to provide an output, and this ensures that the comparator $C_1$ which depends upon the voltages at the terminals 15 and 17 for bias voltage, will only be enabled when a sufficient voltage exists at those terminals. In addition, the feedback path, which includes the delay circuit 30, provided between the terminal 28 and the control terminals 22 and 24 of the comparators $C_1$ and $C_2$ results in having each comparator turn itself off, disable itself, after it provides a low logic output. This disabling of the comparator will be maintained until the next time occurrence of a low level output by the other comparator. This ensures that once a comparator $C_1$ or $C_2$ has provided a low output it will not then subsequently generate multiple additional outputs of low logic states until the other one of the comparators $C_1$ 25 and $C_2$ has produced a low output state. Thus any problems that may be associated with the comparators $C_1$ or $C_2$ providing undesired multiple low output signals have been eliminated.

It should be noted that when the term "disable" is used herein to describe the nonoperative condition of the comparators $C_1$ or $C_2$, it refers to the turning off of the comparators such that they provide an open collector, open circuit, output regardless of the magnitude of the comparator input signals. Thus when a comparator is disabled it cannot provide a low set on signal or a low set off signal no matter what size noise signal may be present on the signal $V_s$. Thus the disabling of the comparators $C_1$ and $C_2$ contemplated herein is not similar to providing these comparators with hysteresis since hysteresis in a comparator can be overcome by an input voltage of sufficient magnitude.

It should be noted that the providing of the time delay circuit 30 is significant because its delay time permits the output of the latch 27 to stabilize without terminating the set or reset input that resulted in the setting or resetting of the latch 27. In other words, without the time delay circuit 30, when the comparator $C_1$, for example, sets the output of latch 27 high, if the comparator $C_1$ were immediately disabled, thus immediately removing the set input to the latch 27, this might result in the output of the latch 27 reverting to a low state. However, the time delay circuit 30 provides sufficient stabilization time for quieting of the output of the latch 27. The delay circuit 30 can comprise just a number of amplifying/inverting buffer stages connected in series.

Figure 3:
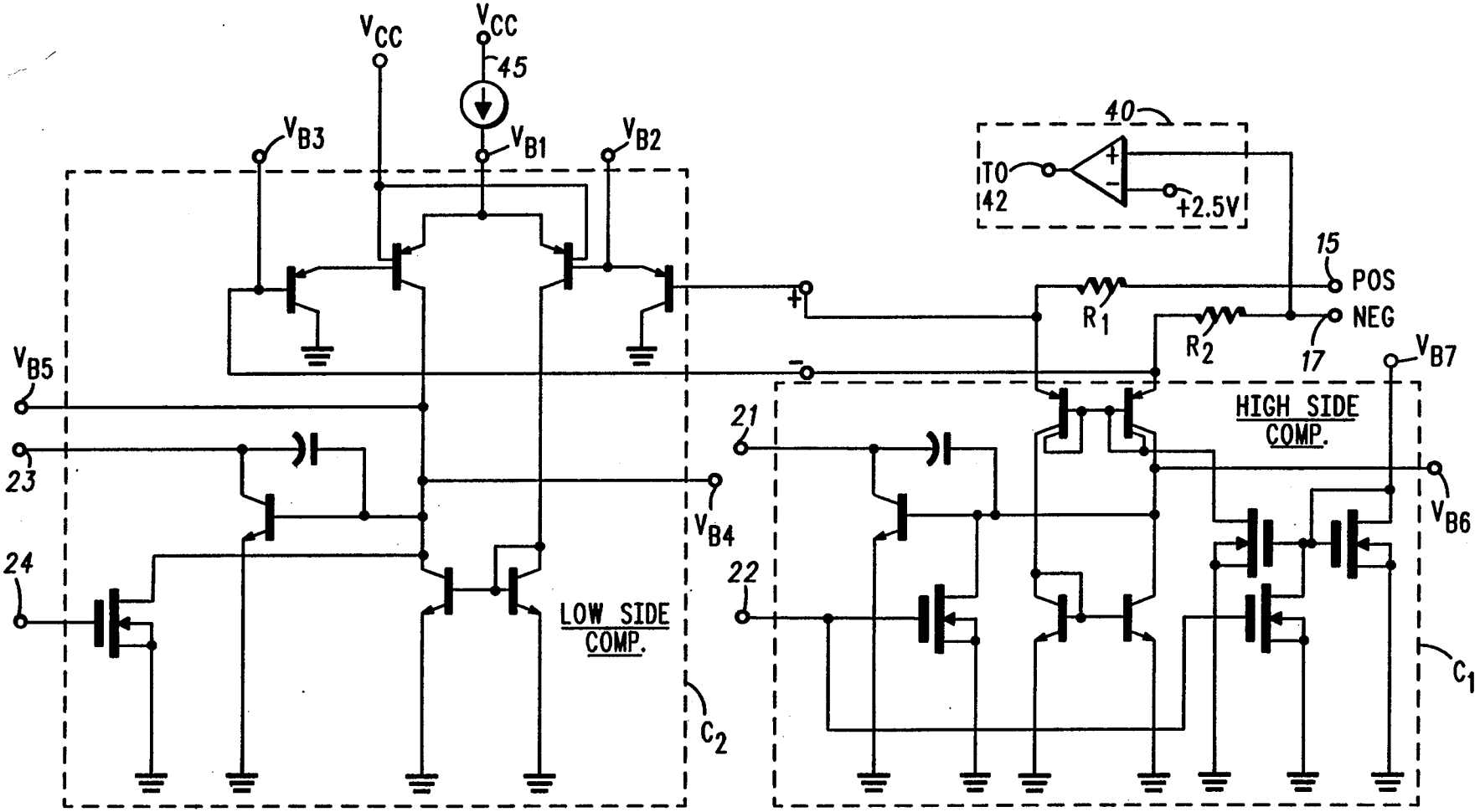
FIG. 3 is a detailed electrical schematic of some of the components shown in block form in FIG. 1.

FIG. 3 illustrates a typical simplified IC configuration for the comparators $C_1$ and $C_2$ wherein various bias voltage/current terminals $V_s$ through $V_{B7}$ are illustrated. The illustrated configuration for comparator $C_1$ indicates how this comparator uses voltages at terminals 15 and 17 for biasing rather than using the 5 volt $V_{cc}$ bias voltage used for comparator $C_2$. However, even without FIG. 3, the above description adequately explains the preferred operation of the load driver circuit 10. FIG. 3 also illustrates the preferred configuration for the comparator lockout/enable circuit 40.

While I have shown and described specific embodiments of this invention, further modifications and improvements will occur to those skilled in the art. All such modifications which retain the basic underlying principles disclosed and claimed herein are within the scope of this invention.

I claim:

1. Load driver circuit comprising:

first comparator means for receiving a load current signal indicative of current flowing through a load and for providing as an output signal a set on signal in response to said load current signal being less than a first threshold;

second comparator means for receiving said load current signal and providing as an output rignal a set off signal in response to said load current exceeding a second threshold more than said first threshold;

driver means coupled to said first and second comparator means for receiving said set on signal and said set off signal and providing a load current control signal for controlling current flow through said load in response thereto;

wherein the improvement comprises means for disabling at least one of said first and second comparator means in response to and after said one of said first and second comparator means provides its output signal, whereby the generation of undesired set on/set off signals due to noise signals is minimized.

2. A load driver circuit according to claim 1 wherein said disabling means includes means for disabling each of said first and second comparator means in response to and after said each of said first and second comparator means provides its output signal, respectively.

3. A load driver circuit according to claim 2 wherein said disabling means includes feedback means, which includes delay circuit means,for providing a time delay between the providing of said set on and set off signals and the resultant disabling of said first and second comparators means in response to said set on and set off signals.

4. A load driver circuit according to claim 3 wherein said time delay provided by said delay circuit means has a magnitude of at least five nanoseconds.

5. A load driver circuit according to claim 3 wherein said driver means comprises a latch means which receives said set on and set off signals and provides in response thereto an output signal at an output of said latch means for determining said load current control signal.

6. A load driver circuit according to claim 5 wherein said latch means output signal is alternately set to high and low logic states by said set on and set off signals.

7. A load driver circuit according to claim 6 wherein said driver means includes logic gate means for receiving said output signal of said latch means and a command signal as inputs and providing said current control signal as an output.

8. A load driver circuit according to claim 5 wherein said feedback means is coupled between said latch means output and said first and second comparator means.

9. A load driver circuit according to claim 2 wherein said disabling means maintains each one of said first and second comparator means disabled until at least the next time occurrence of another of said first and second comparator means providing its output signal.

10. A load driver circuit according to claim 1 wherein said disabling means maintains said one of said first and second comparator means disabled until at least the next time occurrence of another one of said first and second comparator means providing its output signal.

11. A load driver circuit according to claim 1 which includes enabling means for enabling said one of said first and second comparator means after said one of said first and second comparator means has been disabled by said disabling means.

12. Load driver circuit comprising:

first comparator means for receiving a load current signal indicative of current flowing through a load and for providing as an output signal a set on signal in response to said load current signal being less than a first threshold;

second comparator means for receiving said load current signal and providing as an output signal a set off signal in response to said load current exceeding a second threshold more than said first threshold;

driver means coupled to said first and second comparator means for receiving said set on signal and said set off signal and providing a load current control signal for controlling current flow through said load in response thereto, said driver means including an output switching device having a control terminal, which control terminal receives said control signal, and said output switching device having a pair of output terminals, at least one of said output terminals to be coupled to said load;

wherein the improvement comprises means for enabling at least one of said first and second comparator means in response to comparing a sensed voltage, indicative of the voltage at said one output terminal of said device, with respect to a predetermined voltage.

13. A load driver circuit according to claim 12 wherein said enabling means includes means for enabling one of said first and second comparator means in response to said sensed voltage exceeding said predetermined voltage and otherwise enabling a different one of said first and second comparator means.

14. A load driver circuit according to claim 12 wherein said enabling means comprises a third comparator means having one input coupled to said one output terminal of said device.

15. A load driver circuit according to claim 12 wherein said enabling means alternately and repetitively enables one of said first and second comparator means and then another one of said first and second comparator means in response to variations of said sensed voltage provided in response to said set off and set on signals.

16. A load driver circuit according to claim 12 which includes means for disabling at least one of said first and second comparator means in response to and after said one of said first and second comparator means provides its output signal, and wherein said disabling means maintains said one of said first and second comparator means disabled until at least the next time occurrence of another one of said first and second comparator means providing its output signal.

17. A load driver circuit according to claim 16 wherein said disabling means also includes means for disabling said another one of said first and second comparator means in response to and after said another one of said first and second comparator means provides its output signal and wherein said disabling means maintains said another one of said first and second comparator means disabled until at least the next time occurrence of said one of said first and second comparator means providing its output signal.

18. Load driver circuit comprising:

a load having a varying load current therein;

an output switching device having a control input terminal and a pair of output terminals, at least one of said output terminals coupled to said load and said control input terminal receiving a current control signal for controlling said load current in said load;

first comparator means for receiving a load current signal indicative of said load current flowing through said load and for providing as an output signal a set on signal in response to said load current signal being less than a first threshold;

second comparator means for receiving said load current signal and providing as an output signal a set off signal in response to said load current exceeding a second threshold more than said first threshold;

driver means, which includes said output switching device, coupled to said first and second comparator means for receiving said set on signal and said set off signal and providing said load current control signal in response thereto;

means for disabling one of said first and second comparator means in response to and after said one of said said first and second comparator means provides its output signal; and means for enabling said one of said first and second comparator means in response to comparing a sensed voltage, indicative of the voltage at said one output terminal of said switching device, with respect to a predetermined voltage.

19. A load driver circuit according to claim 18 wherein said disabling means includes means for disabling each of said first and second comparator means in response to and after said each of said first and second comparator means provides its output signal, respectively, and wherein said enabling means enables each of said first and second comparator means in response to the comparison of said sensed voltage after the disabling of each of said first and second comparator means by said disabling means.

20. A load driver circuit according to claim 19 which includes a load current sensing resistor connected in series with said load, said load current signal being provided across said load current sensing resistor.

* * * * *